US006513471B1

(12) United States Patent
Hicks

(10) Patent No.: US 6,513,471 B1
(45) Date of Patent: Feb. 4, 2003

(54) CYLINDER DEACTIVATION ENGINE WITH ADVANCED EXHAUST CAM TIMING AND METHOD

(75) Inventor: James B. Hicks, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/068,510

(22) Filed: Feb. 6, 2002

(51) Int. Cl.[7] ..... F01L 1/34
(52) U.S. Cl. ..... 123/90.16; 123/90.52
(58) Field of Search ..... 123/90.52, 90.16

(56) References Cited

U.S. PATENT DOCUMENTS 4,054,109 A * 10/1977 Herrin et al. ..... 123/90.16
4,633,403 A * 12/1986 Asmus ..... 123/90.16
4,811,698 A * 3/1989 Akasaka et al. ..... 123/90.17
4,858,574 A * 8/1989 Fukuo et al. ..... 123/90.16
5,490,486 A * 2/1996 Diggs ..... 123/198 F
5,960,755 A * 10/1999 Diggs et al. ..... 123/568.14
5,975,052 A * 11/1999 Moyer ..... 123/198 F

FOREIGN PATENT DOCUMENTS

JP 06167205 A * 6/1994 ..... F01L/01/30

* cited by examiner

*Primary Examiner*—Thomas Denion
*Assistant Examiner*—Kyle M. Riddle
(74) *Attorney, Agent, or Firm*—Leslie C. Hodges

(57) ABSTRACT

An engine has switching valve actuators with positive valve lash for actuating or deactivating valves of deactivation cylinders and conventional valve actuators with negligible valve lash for actuating valves of conventional cylinders. Cams for the deactivation cylinders have increased opening and closing ramps relative to cams of the conventional cylinders. This can lead to poor combustion quality at idle and light loads and result in perceived engine roughness by an operator. To compensate for this, timing of exhaust cams of the deactivation cylinders is advanced relative to those of the conventional cylinders to reduce valve overlap of the deactivation cylinders to sufficiently near that of the conventional cylinders to provide stable combustion at idle in both conventional and deactivation cylinders with nearly equivalent power operation of all the cylinders.

12 Claims, 3 Drawing Sheets

CYLINDER DEACTIVATION ENGINE WITH ADVANCED EXHAUST CAM TIMING AND METHOD

TECHNICAL FIELD

This invention relates to cylinder deactivation engines having switching valve actuators for deactivating selected cylinders of an engine. In particular, the invention involves modification of camshaft cam timing for improved operation of a cylinder deactivation engine.

BACKGROUND OF THE INVENTION

It is known in the art relating to cylinder deactivation engines to provide lost motion hydraulic valve lifter or lash adjuster devices with sliding pin latching mechanisms, hereafter called latching pins. These lost motion devices may be referred to as switching valve actuators and can include both collapsible valve lifters with internal lash adjusters and stationary collapsible lash adjusters used as pivot members in engine valve gear.

The latching pins of such switching valve actuators require a mechanical lash component to insure free movement of the latching pins. As a result, the mechanisms are designed so that the hydraulic lash adjuster or lifter cannot compensate for the required mechanical lash. To prevent valve train noise, this mechanical lash must be taken up by additional camshaft cam ramp height added to the opening and closing side hydraulic ramps in each valve line containing a lost motion (switching) valve actuator. Further, to prevent noise with all the expected variations in the actual mechanical lash in a population of production parts, the additional ramp must be equal to the maximum allowed mechanical lash plus any wear expected during the life of the engine.

While the increased ramps will remove the possibility of valve train noise due to the mechanical lash component of the switching valve actuators, they will also increase the valve overlap area in every valve line having a switching valve actuator, except in the case of a maximum mechanical lash condition, due to the additional ramp height remaining after a less than worse case lash is removed. The additional overlap area can lead to a significant degradation in combustion quality during lightly loaded conditions and at idle and result in a perceived roughness by an operator. A method of overcoming these potential negative effects with a minimum of engine modification is accordingly desired.

SUMMARY OF THE INVENTION

The present invention provides a modification of engine cam timing which substantially reduces or eliminates increased valve overlap area resulting from the mechanical ramps previously discussed. In a typical engine, the timing of exhaust valves relative to intake valves within each cylinder is designed to be identical across all cylinders of the engine. If the valve timing is altered from cylinder to cylinder, it is possible to vary the resulting overlap in each cylinder as well.

The present invention provides an advance of exhaust cam timing for the cylinders with switching valve actuators while keeping the intake valve timing fixed. The advanced exhaust cam timing reduces the additional overlap created by the mechanical lash. The remaining cylinders without switching valve actuators are not changed. Advance of the exhaust valve timing is chosen because engine performance does not change significantly as exhaust valve timing is changed within a certain limited range of values, while even small changes in intake cam timing can significantly affect engine torque output.

These and other features and advantages of the invention will be more fully understood from the following description of certain specific embodiments of the invention taken together with the accompanying drawings.

DESCRIPTION OF THE PREFERRED EMBODIMENT

Figure 1:
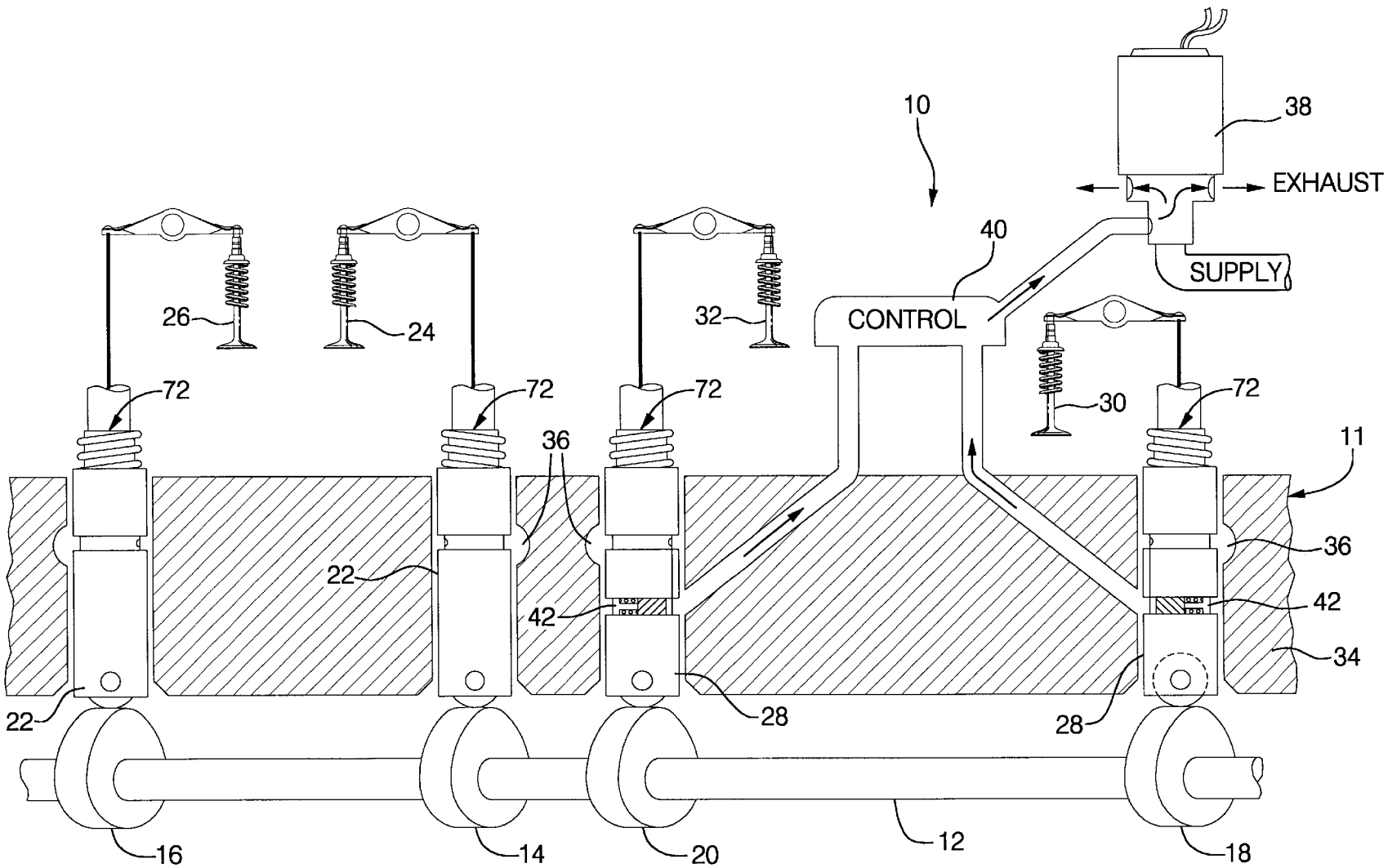
FIG. 1 is a diagrammatic view of an engine including both conventional and switching valve actuators or valve lifters for actuating the valves of the engine and in which advanced exhaust valve timing is provided for the deactivation cylinders.

Referring now to the drawings in detail, numeral 10 generally indicates an internal combustion engine having a plurality of similarly constructed engine cylinders, not shown, arranged in a cylinder bank 11. Some of the cylinders, called deactivation cylinders, are able to be deactivated during engine operation while the remainder of the cylinders, referred to as conventional cylinders, continue in normal operation while the engine is running.

The engine includes a camshaft 12 having an intake cam 14 and an exhaust cam 16 for each of the conventional cylinders as well as an intake cam 18 and an exhaust cam 20 for each of the deactivation cylinders. The intake and exhaust cams 14, 16 actuate conventional valve lifters 22 which are connected to actuate intake and exhaust valves 24, 26 of the conventional cylinders of the engine. Cams 18, 20 actuate switching valve lifters 28 which are connected to actuate intake and exhaust valves 30, 32 of the deactivation cylinders of the engine.

Both the conventional and switching valve lifters 22, 28 are mounted in a lifter gallery 34 that forms a part of the cylinder bank 11. The lifter gallery provides a pressure oil feed 36 to lash adjusters mounted internally of the lifters 22, 28. The switching valve lifters 28 are additionally supplied with control oil pressure through a control system including a control valve 38 connected to alternately pressurize or exhaust a control passage network 40 connecting with latching pins 42 of the switching lifters 28. The switching lifters 28 are provided with internal mechanical lash, which is required to insure reengagement of the latching pins when the deactivation oil pressure in the control passage network is exhausted through the control valve 38. The conventional lifters 22, on the contrary, have no significant mechanical lash.

As a result, the camshaft intake and exhaust cams 18, 20, for the deactivation cylinders, are required to include additional ramp height beyond that required for the hydraulic lash adjuster actuation in order to take up the mechanical lash in the deactivation lifters 28 and avoid creating lifter noise which would be objectionable to an operator. The conventional lifters 22 have no mechanical lash so that increased ramp heights are not provided on the intake and exhaust cams 14, 16. The result is that the deactivating cylinders have increased exhaust to intake valve overlap as will be discussed in connection with FIG. 2 of the drawings. The increased overlap creates cylinder conditions which may result in poor combustion at low loads and idle operation of the deactivation cylinders and may be objectionable to the engine or vehicle operator.

Figure 2:
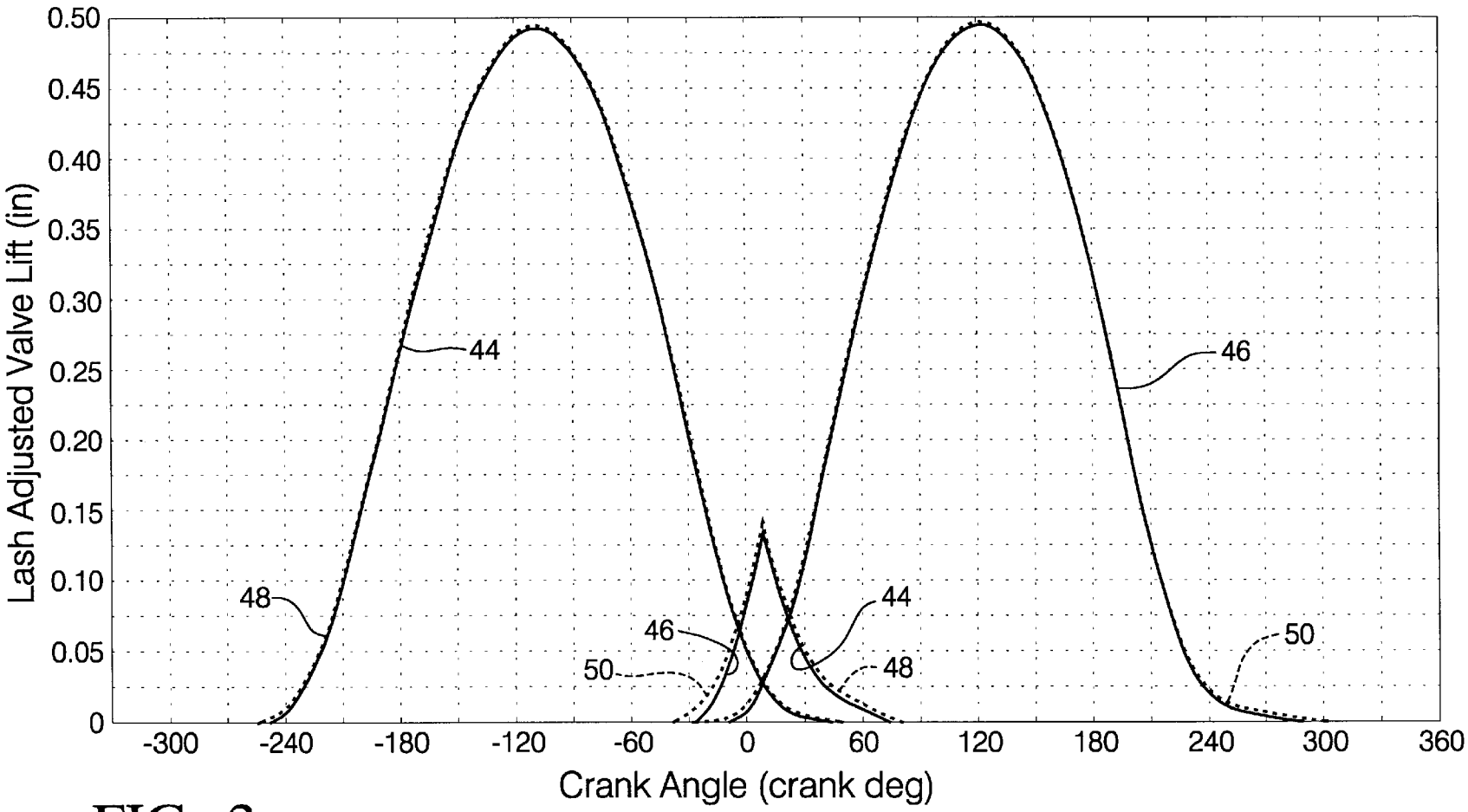
FIG. 2 is a valve overlap plot for an engine with conventional and deactivating cylinders without advanced exhaust cam timing.

Referring to FIG. 2, solid line 44 indicates the lift curve of a conventional exhaust cam 16 and solid line 46 indicates the lift curve of a conventional intake cam 14. Dashed line 48 indicates the lift curve of a deactivation exhaust cam 20 and dashed line 50 indicates the lift curve of a deactivation intake cam 18. Note that in this embodiment the timing of the deactivation cams is the same as the timing of the corresponding conventional cams. However, their lift curves differ because of the differing ramp heights for the conventional and deactivation cams. In the center of FIG. 2, an enlarged view of the overlap portion of the exhaust and intake valve lift curves is shown wherein lines 44, 46, 48 and 50 are more easily seen with the differences in their paths along the ramp portions of the cams.

Figure 3:
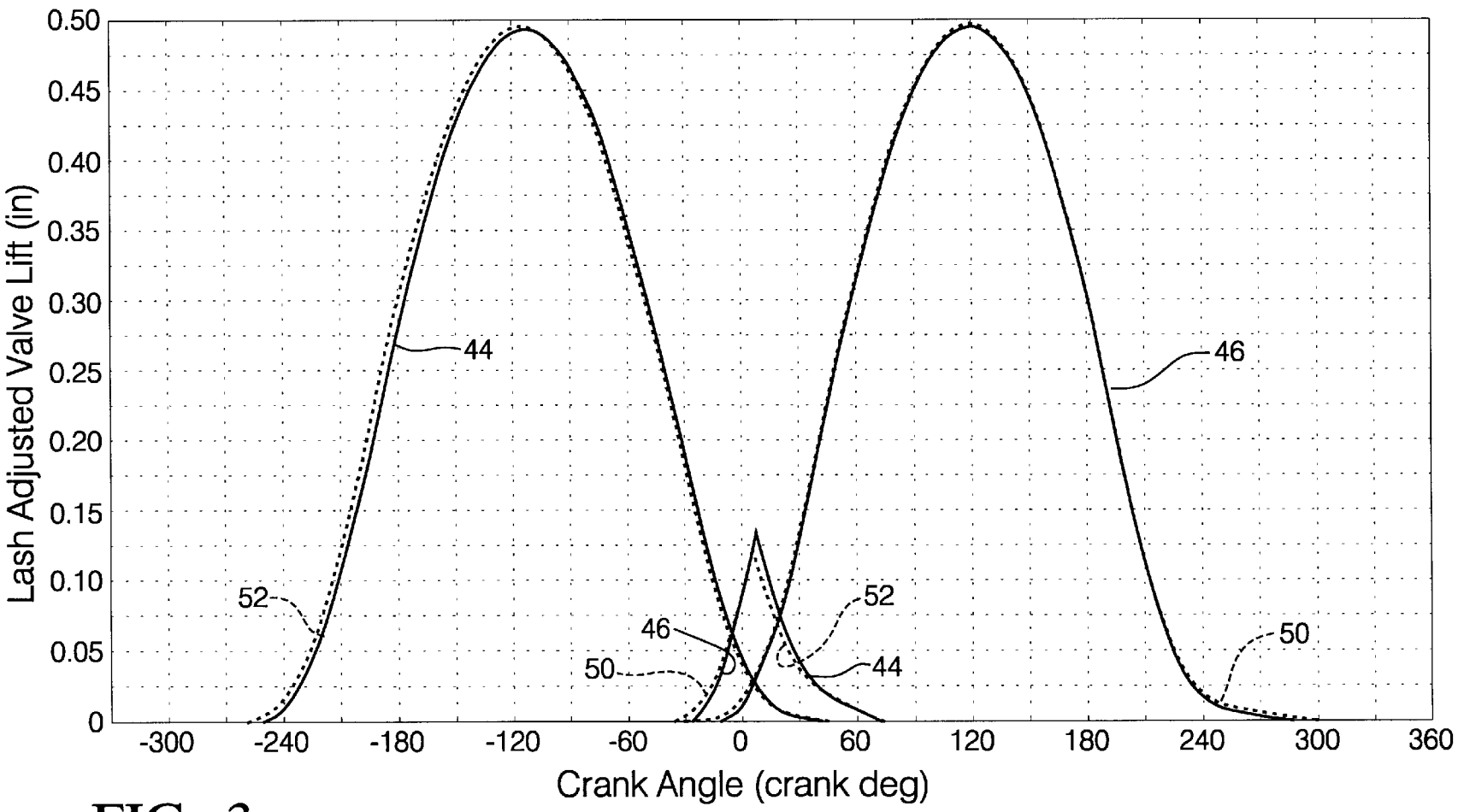
FIG. 3 is a plot similar to FIG. 2 but showing the effect of advanced exhaust cam timing according to the invention.

FIG. 3 illustrates a modified camshaft cam timing arrangement according to the invention. In the drawings, lines 46 and 50 indicate the lift curves of the intake cams of the engine. The lift curves and timing are identical with those of FIG. 2 so that the same numerals are utilized for their identification. Likewise, the solid line 44 which indicates the cam lift and timing of the conventional exhaust cam 16 is identical to the same numbered line of FIG. 2.

However, the novel feature of the invention is that the timing of the deactivation exhaust cam 20 has been advanced by two degrees from the timing of the cam illustrated in FIG. 2. The cam lift curve remains the same, however, although it could be changed if desired. The resulting path of the advanced exhaust cam valve lift is shown by the dashed line 52.

It should be noted that advancing the timing of the exhaust cam lift curve two degrees reduces the effective valve overlap of the deactivation cylinders as compared to the conventional cylinders. In the illustrated figures, the valve overlap area measured at the cams for the conventional cylinders is about 0.42 degree inches while the overlap area for the deactivation cams is about 0.06 degree inches greater. However, with the exhaust cam advanced two degrees, the overlap area of the deactivation cams is reduced to very near the overlap area of the conventional cylinder cams. Thus, as a result of advancing only the exhaust deactivation cam timing by two degrees, engine combustion stability is maintained essentially similar in both the conventional and deactivation cylinders when they are operating and the effect of engine performance between the two cylinder types is essentially unchanged, differing by less than one percent.

As may be understood from the foregoing description of an exemplary embodiment, the result of the method is elimination or lessening of the increased valve overlap from the mechanical ramp effect of the cams for the deactivation cylinders under nominal lash conditions. The amount of exhaust valve timing advance needed to normalize the valve overlap between deactivation and conventional cylinders will vary by application depending upon such factors as the lash adjuster mechanical lash specifications, the camshaft cam ramp design and the baseline cam timing. Thus, the deactivation exhaust cam timing advance of two degrees, shown effective for the exemplary engine system described, shows the potential effectiveness of a small change, but leaves open for determination the amount of the advance needed for other engine embodiments. At present, an exhaust cam timing advance in the range of about 2 to 5 degrees is thought to be preferable for use with valve switching deactivation mechanisms as currently known. However, an enlarged range of about 1 to 7 degrees advance may be useful in various engine embodiments.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A camshaft for an engine having switching valve actuators for switching the valves of selected engine cylinders between normally operating and closed non-operating conditions to deactivate the selected engine cylinders, the camshaft including at least one cam for each of the intake and exhaust valves operable by the camshaft, including both conventional and deactivation cylinders;

the switching valve actuators for actuating the valves of the deactivation cylinders having lash adjusters with a positive valve lash and the valve actuators for the conventional cylinders having lash adjusters without significant valve lash so that camshafts having cams providing equivalent gas flow through the conventional and deactivation cylinders and having identical intake and exhaust valve timing have greater valve overlap in the deactivation cylinders than in the conventional cylinders due to increased opening and closing ramps on the cams of the deactivation cylinders needed to minimize opening and closing loading of the cams and valve actuators;

the camshaft having timing for the exhaust cams of the deactivating cylinders advanced sufficiently to substantially reduce the difference in valve overlap between the conventional and deactivation cylinders without significantly unbalancing the performance of the various cylinders.

2. A camshaft as in claim 1 wherein the difference in timing of the exhaust cams for the conventional and deactivation cylinders is in a range of from about 1 to 7 degrees.

3. A camshaft as in claim 1 wherein the difference in timing of the exhaust cams for the conventional and deactivation cylinders is in a range of from about 2 to 5 degrees.

4. A camshaft as in claim 1 wherein the difference in timing of the exhaust cams for the conventional and deactivation cylinders is about 2 degrees.

5. An engine having switching valve actuators with positive valve lash for actuating or deactivating valves of deactivation cylinders and conventional valve actuators with negligible valve lash for actuating valves of conventional cylinders, and cams for the deactivation cylinders having increased opening and closing ramps relative to cams of the conventional cylinders, wherein timing of exhaust cams of the deactivation cylinders relative to those of the conventional cylinders is advanced to reduce valve overlap of the deactivation cylinders to sufficiently near that of the conventional cylinders to provide stable combustion at idle in both conventional and deactivation cylinders with nearly equivalent power operation of all the cylinders.

6. An engine as in claim 5 wherein the relative timing of the deactivation cylinder exhaust cams is advanced by a value in the range of from about 1 to 7 degrees.

7. An engine as in claim 5 wherein the relative timing of the deactivation cylinder exhaust cams is advanced by a value in the range of from about 2 to 5 degrees.

8. An engine as in claim 5 wherein the relative timing of the deactivation cylinder cams is advanced by a value of about 2 degrees.

9. A method of operating an engine having switching valve actuators with positive valve lash for actuating or deactivating valves of deactivation cylinders and conventional valve actuators with negligible valve lash for actuating valves of conventional cylinders, and cams for the deactivation cylinders having increased opening and closing ramps for the deactivation cylinders relative to cams of the conventional cylinders, the method comprising:

advancing the timing of the exhaust cams of the deactivation cylinders relative to those of the conventional cylinders to reduce valve overlap of the deactivation cylinders to sufficiently near that of the conventional cylinders to provide stable combustion at idle in both conventional and deactivation cylinders with nearly equivalent power operation of all the cylinders.

10. A method as in claim 9 wherein the relative timing of the deactivation cylinder exhaust cams is advanced by a value in the range of from about 1 to 7 degrees.

11. A method as in claim 9 wherein the relative timing of the deactivation cylinder exhaust cams is advanced by a value in the range of from about 2 to 5 degrees.

12. A method as in claim 9 wherein the relative timing of the deactivation cylinder exhaust cams is advanced by a value of about 2 degrees.

* * * * *